US005971263A

United States Patent [19]

Mangano

[11] Patent Number: 5,971,263

[45] **Date of Patent: *Oct. 26, 1999**

[54] FOLDING BOX WITH REMOVABLE SHELF PARTICULARLY SUITED FOR CONTAINING BAKED GOODS

[76] Inventor: Joy Mangano, 49 Sunhill Rd., Nesconset, N.Y. 11767

[ * ] Notice: This patent issued on a continued prosecution application filed under 37 CFR 1.53(d), and is subject to the twenty year patent term provisions of 35 U.S.C. 154(a)(2).

[21] Appl. No.: 08/562,359

[22] Filed: Nov. 22, 1995

[51] Int. Cl.[6] ..... B65D 1/40; B65D 25/04

[52] U.S. Cl. ..... 229/110; 220/62; 220/529; 220/618; 220/621; 229/5.5; 229/117.06; 229/120.32

[58] Field of Search ..... 229/5.5, 23 A, 229/110, 117.06, 120.32, 125.11; 220/62, 337, 339, 529, 606, 618, 621

[56] References Cited

U.S. PATENT DOCUMENTS

| | | | |
|---|---|---|---|
| 21,748 | 10/1858 | Dreyspring | 229/125.11 |
| 1,558,155 | 10/1925 | Flansburg | 229/5.5 |
| 1,633,904 | 6/1927 | Peterson | 229/23 A |
| 1,995,053 | 3/1935 | Carruthers . | |
| 2,005,415 | 6/1935 | Ebner | 229/23 A |
| 2,120,871 | 6/1938 | Rudowitz . | |
| 2,304,373 | 12/1942 | Palmer . | |
| 2,934,254 | 4/1960 | Ullger . | |
| 3,145,904 | 8/1964 | Bromley | 220/62 |
| 3,330,437 | 7/1967 | Bellamy | 220/62 |
| 3,432,061 | 3/1969 | Anderson | 220/62 |
| 3,539,089 | 11/1970 | Osberg . | |
| 3,768,720 | 10/1973 | Bundy | 229/120.32 |
| 3,873,017 | 3/1975 | Blatt . | |
| 4,530,459 | 7/1985 | Maroszek | 229/120.32 |
| 4,917,288 | 4/1990 | Heitele et al. . | |
| 5,123,540 | 6/1992 | Karavias | 220/339 |

FOREIGN PATENT DOCUMENTS

| | | | |
|---|---|---|---|
| 340091 | 6/1904 | France | 229/110 |
| 267768 | 10/1911 | Germany | 229/110 |
| 644725 | 10/1950 | United Kingdom | 229/110 |

*Primary Examiner*—Gary E. Elkins
*Attorney, Agent, or Firm*—Galgano & Burke

[57] ABSTRACT

A foldable box includes six substantially rectangular plastic sides which are connected to each other by live hinges so that the sides may be folded flat or opened to a substantially hexagonal configuration. A substantially hexagonal plastic bottom is connected to the bottom edge of one of the sides by a live hinge and a substantially hexagonal plastic top is connected to the top edge of one of the sides by a live hinge. An inner flange extends substantially orthogonally from the bottom edges of at least two of the sides other than the one to which the plastic bottom is attached for supporting the plastic bottom when the box is assembled by folding. An outer extending flange is provided on at least two edges of the plastic top to support it when the box is folded closed. A removable substantially hexagonal plastic shelf is preferably provided and inner surfaces of at least two sides are provided with interior flanges to support the shelf. According to a presently preferred embodiment, the box is made from a molded plastic blank which is ultrasonically welded.

25 Claims, 5 Drawing Sheets

FOLDING BOX WITH REMOVABLE SHELF PARTICULARLY SUITED FOR CONTAINING BAKED GOODS

BACKGROUND OF THE INVENTION

1. Field of the Invention

The invention relates to folding boxes. More particularly, the invention relates to a six-sided plastic collapsible box having an integral lid and a removable shelf.

2. State of the Art

A foldable hexagonal box is disclosed in U.S. Pat. No. 2,120,871 to Rudowitz. The box is made from a flat blank which is cut and folded to form a box having six sides and an integral bottom. The bottom is provided with several relatively complex triangular flaps which allow the bottom to be secured to the sides. No top for the box is disclosed.

A hexagonal box designed to contain baked goods is disclosed in U.S. Pat. No. 2,304,373 to Palmer. The box is made from three separate pieces: a bottom piece, a top piece, and an annular band. The box is held together by the inherent resiliency of the paperboard from which the pieces are made and the sizing of the annular band which must fit snugly.

U.S. Pat. No. 2,934,254 to Ullger discloses a folding box similar to that of Rudowitz. However, Ullger's box provides hooked tongues and slots to hold the bottom in place. A separate lid is also disclosed.

Other box and container constructions are disclosed in Carruthers, U.S. Pat. No. 1,995,053, Osberg, U.S. Pat. No. 3,539,089, Blatt, U.S. Pat. No. 3,873,017 and Heitele, et al, U.S. Pat. No. 4,917,288. These boxes are generally difficult to assemble, usually requiring many folds and the insertion of tabs, etc. In addition, once assembled, they are not easily broken down to flat condition for storage and reuse. Further, the known boxes are most often made of degradable material such as paperboard which cannot be cleaned for reuse without damaging the box.

SUMMARY OF THE INVENTION

It is therefore an object of the invention to provide a foldable box which is particularly suited for containing baked goods and which is easy to assemble.

It is also an object of the invention to provide a foldable box which is particularly suited for containing baked goods and which is easily re-folded flat from an assembled condition.

It is another object of the invention to provide a foldable box which is particularly suited for containing baked goods and which is reusable.

It is still another object of the invention to provide a foldable box which is particularly suited for containing baked goods and which can be cleaned for reuse without damaging the box.

Yet another object of the invention is to provide a foldable box which is particularly suited for containing baked goods and which has a removable shelf.

In accord with these objects which will be discussed in detail below, the foldable box of the present invention includes six substantially rectangular plastic sides which are connected to each other by live hinges so that the sides may be folded flat or opened to a substantially hexagonal configuration. A substantially hexagonal plastic bottom is connected to the bottom edge of one of the sides by a live hinge and a substantially hexagonal plastic top is connected to the top edge of one of the sides by a live hinge. An inner flange extends substantially orthogonally from the bottom edges of at least one of the sides other than the one to which the plastic bottom is attached for supporting the plastic bottom when the box is assembled by folding. An outer extending flange is provided on at least one edge of the plastic top to support it when the top is folded closed. A removable substantially hexagonal plastic shelf is preferably provided and inner surfaces of at least two sides are provided with interior flanges to support the shelf.

According to the presently preferred embodiment of the invention, the foldable box is made from a plastic blank having seven substantially rectangular panels arranged linearly with six integral live hinges defining the panels, a hexagonal bottom panel attached to the bottom edge of a central one of the rectangular panels by an integral live hinge, and a hexagonal cover panel attached to the top edge of the central rectangular panel by an integral live hinge. The two outermost rectangular panels are approximately one half the size of the other rectangular panels and are joined together at their respective free ends by ultrasonic welding to form a single panel which is substantially the same size as the five other rectangular panels. Each of the rectangular panels is provided with an interior shelf flange for supporting a removable hexagonal plastic shelf. The bottom edges of the rectangular panels other than the central panel are provided with bottom panel engaging flanges to hold the bottom panel when folded according to the invention. The periphery of the bottom panel is provided with a flange for engaging the flanges on the rectangular panels. The cover panel is provided with an upper peripheral flange for preventing the cover from falling into the box when the cover is folded closed and the cover panel is also provided with a lifting tab. An hexagonal plastic shelf for use in the foldable box is also provided and, according to a presently preferred embodiment, the shelf is provided with two arcuate, finger-hole cutouts so that it can be easily lifted out of the box after it is installed.

The box is manufactured from the blank by first folding the bottom panel up against the interior of the central panel and then ultrasonically welding the free ends of the outermost panels. The box may then be folded substantially flat in a relatively compact configuration in which the bottom panel resides between the six side panels and the top panel resides outside the six side panels. The folded box is used by lifting the side panels into a substantially hexagonal configuration while pivoting the bottom panel approximately 90° to resiliently engage the flanges on the bottom edges of the side panels, with the inherent resiliency of the side panels allowing the same to flex and permit pivotal movement or folding of the bottom panel from a folded to an erect position and vice versa. The shelf is optionally placed inside the box on the shelf supporting flanges and the top is pivoted or folded approximately 270° so that its outer flange rests against the upper edges of the side panels. The described folding of the box may be reversed so that the box is returned to a substantially flat configuration for storage and reuse. The plastic material from which the box is made is preferably dishwasher safe so that the box may be easily washed between uses.

DETAILED DESCRIPTION OF THE PREFERRED EMBODIMENTS

Figure 2:
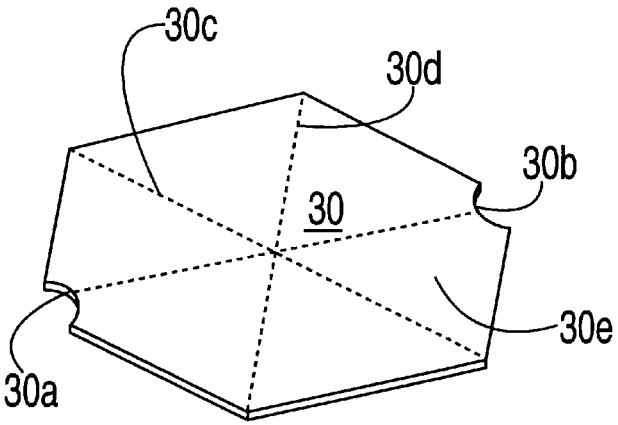
FIG. 2 is a perspective view of a removable shelf for the box of FIG. 1.
Figure 1:
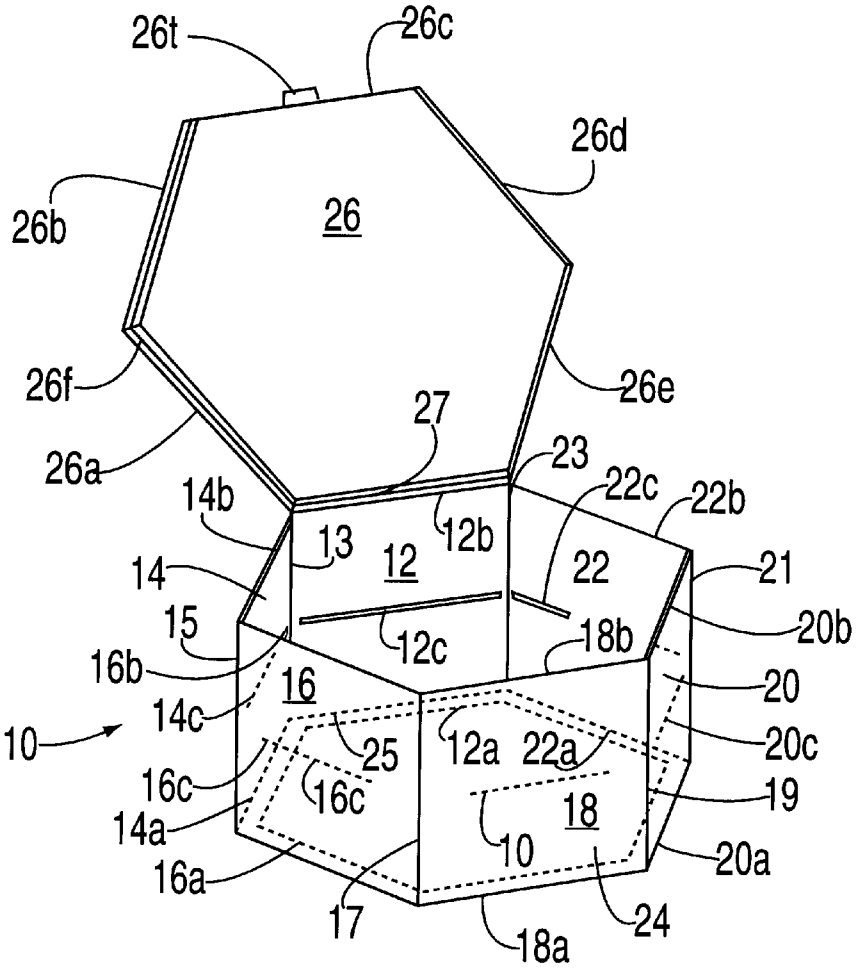
FIG. 1 is a perspective view of a partially assembled folding box according to the invention.
Figure 3:
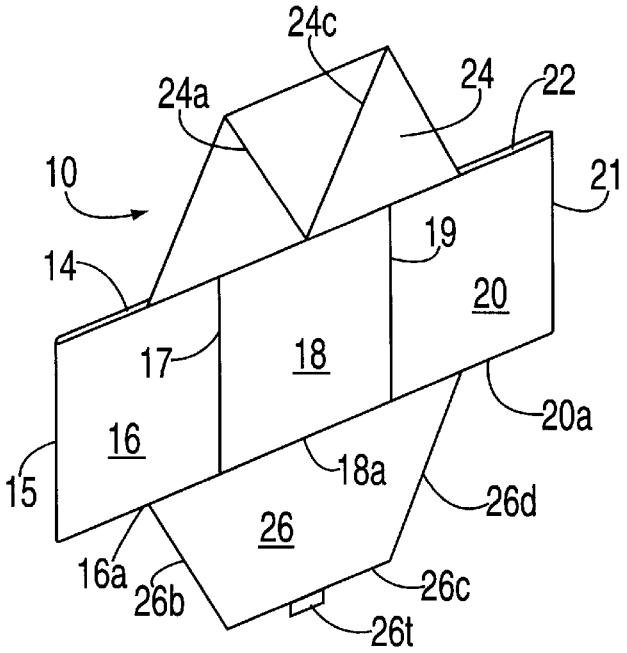
FIG. 3 is a perspective view of the box of FIG. 1 folded substantially flat.
Figure 5:
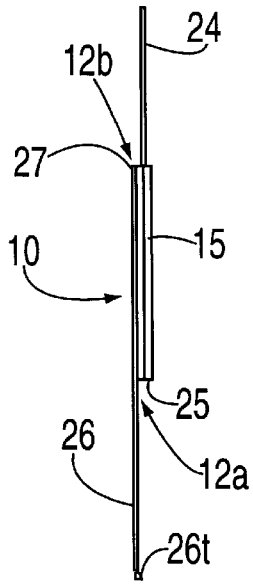
FIG. 5 is a side elevation view looking in the direction 5—5 shown in FIG. 4.
Figure 4:
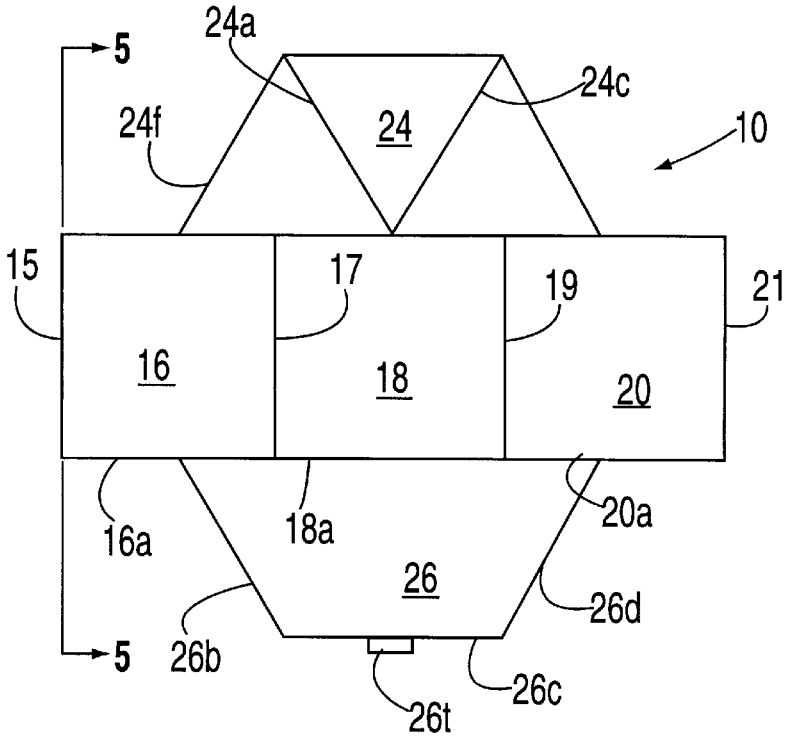
FIG. 4 is a plan view of the box of FIG. 1 folded substantially flat.

Referring now to FIGS. 1 through 5, a foldable box 10 according to the invention includes six substantially rectangular plastic sides 12, 14, 16, 18, 20, 22 which are connected to each other by live hinges 13, 15, 17, 19, 21, 23 so that the sides may be folded flat as shown in FIGS. 3–5 or opened to an erected, substantially hexagonal configuration as shown in FIG. 1. A substantially hexagonal plastic bottom 24 is connected to the bottom edge 12*a* of the side 12 by a live hinge 25 and a substantially hexagonal plastic top 26 is connected to the top edge 12*b* of side 12 by a live hinge 27. The bottom edges 14*a*, 16*a*, 18*a*, 20*a*, and 22*a* of each of the other sides 14, 16, 18, 20, and 22 is provided with an inner flange (not shown in FIGS. 1–5, but described in more detail below with reference to FIGS. 6–10) for supporting the plastic bottom 24 when the box is assembled by folding to the erected configuration shown in FIG. 1. The five free edges 26*a*–26*e* of the top 26 are provided with an outer extending lip or flange 26*f* (described in more detail below with reference to FIGS. 6–10). The edge 26*c* of the top 26 is preferably provided with a lifting tab 26*t*. According to a preferred embodiment of the invention, a removable substantially hexagonal plastic shelf 30 is provided (FIG. 2) and inner surfaces of the rectangular sides 12, 14, 16, 18, 20, 22 are provided with interior flanges 12*c*, 14*c*, 16*c*, 18*c*, 20*c*, 22*c* to support the shelf 30. The shelf 30 is preferably provided with two arcuate finger-hole cutouts 30*a*, 30*b* so that it can be easily lifted out of the box 10 after it is installed.

From the foregoing, those skilled in the art will appreciate that the box 10 may then be folded substantially flat to a relatively compact configuration shown in FIGS. 3–5 in which the bottom panel 24 resides between the panels 12, 14, and 22 on one side and panels 16, 18, and 20 on the other side. The top panel 26 resides outside the six side panels and lies against panels 12, 14, and 22. The box 10 is folded from the substantially flat configuration shown in FIGS. 3–5 to the usable erected configuration shown in FIG. 1 by lifting the side panels 16, 18, 20 while folding the bottom panel approximately 90° to engage the flanges on the bottom edges of the side panels. The panels are sufficiently resilient to enable them to flex and allow passage of the bottom panel therebetween. The shelf 30 is optionally placed inside the box on the shelf supporting flanges 12*c*–22*c* and the top 26 is folded approximately 270° so that its outer lip or flange 26*f* rests against the upper edges 14*b*–22*b* of the side panels 14–22. The described folding of the box may be reversed so that the box is returned to a substantially flat configuration for storage and reuse. The plastic material from which the box is made is preferably dishwasher safe so that the box may be easily washed between uses.

Turning now to FIGS. 6–11, according to the presently preferred embodiment of the invention, the foldable box 10 (FIG. 1) is made from a plastic blank 100 having seven substantially rectangular panels 12, 14, 16, 18', 18", 20, 22 arranged linearly with six integral live hinges 13, 15, 17, 19, 21, 23 defining the panels. A hexagonal bottom panel 24 is attached to the bottom edge 12*a* of the central panel 12 by an integral live hinge 25, and a hexagonal cover panel 26 attached to the top edge 12*b* of the central rectangular panel 12 by an integral live hinge 27.

The two outermost rectangular panels 18' and 18" are approximately one half the size of the other rectangular panels and are joined together at their respective free ends 18'*e*, 18"*e*, via a shiplap joint bonded together by ultrasonic welding to form a single panel (18 in FIG. 1) which is substantially the same size as the five other rectangular panels. To aid registration of the ends 18'*e* and 18"*e*, a series of tongues 18'*t* are provided on the end of panel 18' and a corresponding series of mating grooves 18"*g* are provided on the end of panel 18". Each of the rectangular panels 12, 14, 16, 18', 18", 20, 22 is provided with an interior shelf flange 12*c*, 14*c*, 16*c*, 18'*c*, 18"*c*, 20*c*, 22*c* for supporting the removable hexagonal plastic shelf 30 (shown in FIG. 2).

Figure 6:
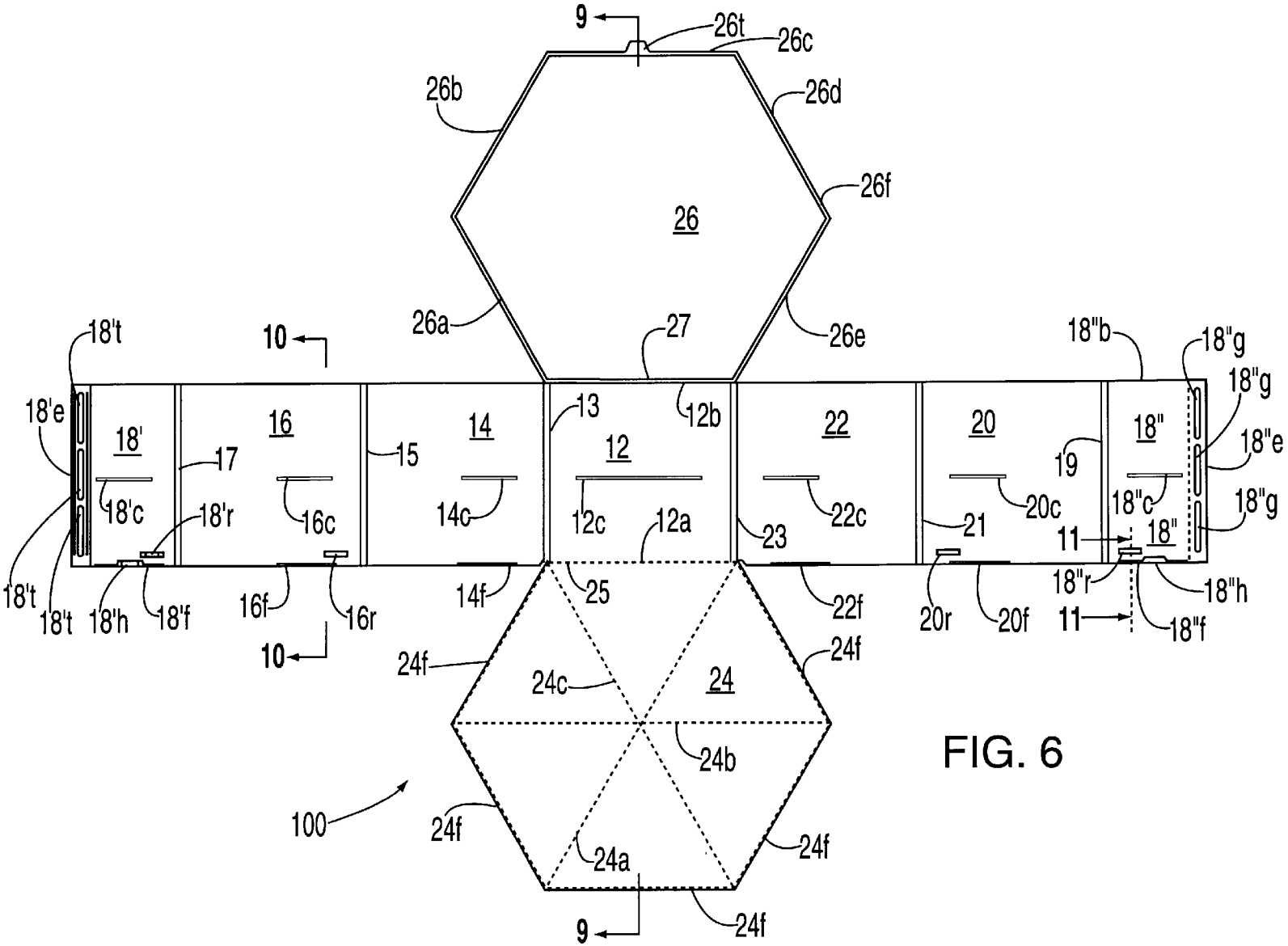
FIG. 6 is a plan view of a presently preferred embodiment of the blank used to make the box of FIG. 1.
Figure 7:
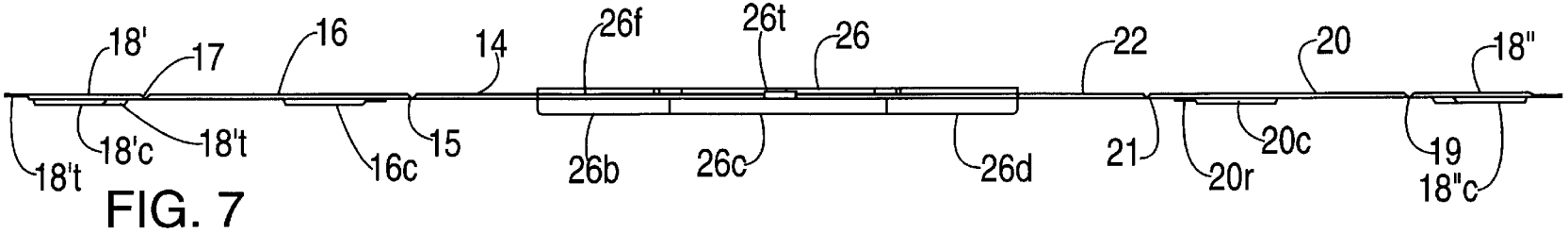
FIG. 7 is a top edge view of the blank of FIG. 6.
Figure 8:
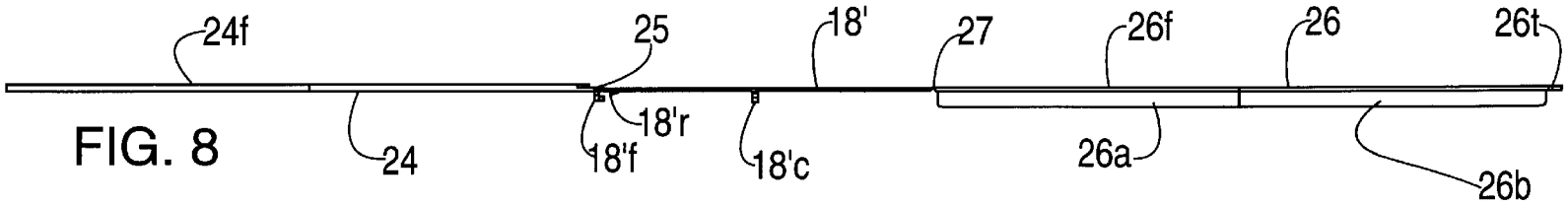
FIG. 8 is a left side edge view of the blank of FIG. 6.
Figure 9:
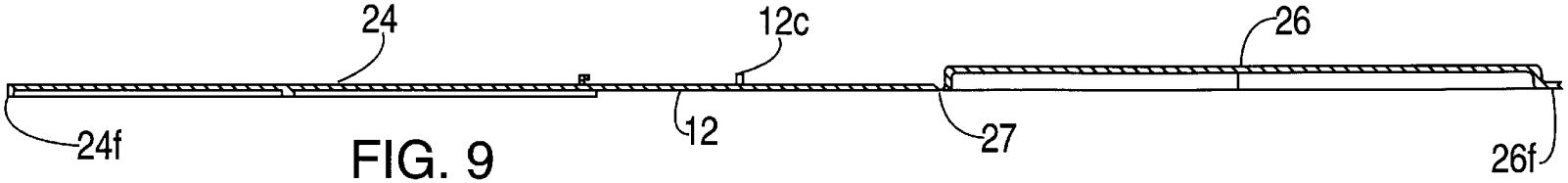
FIG. 9 is a sectional view taken along line 9—9 in FIG. 6.
Figure 10:
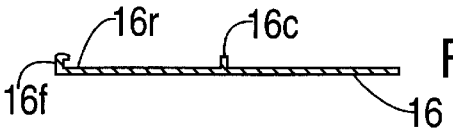
FIG. 10 is a sectional view taken along line 10—10 in FIG. 6.
Figure 11:
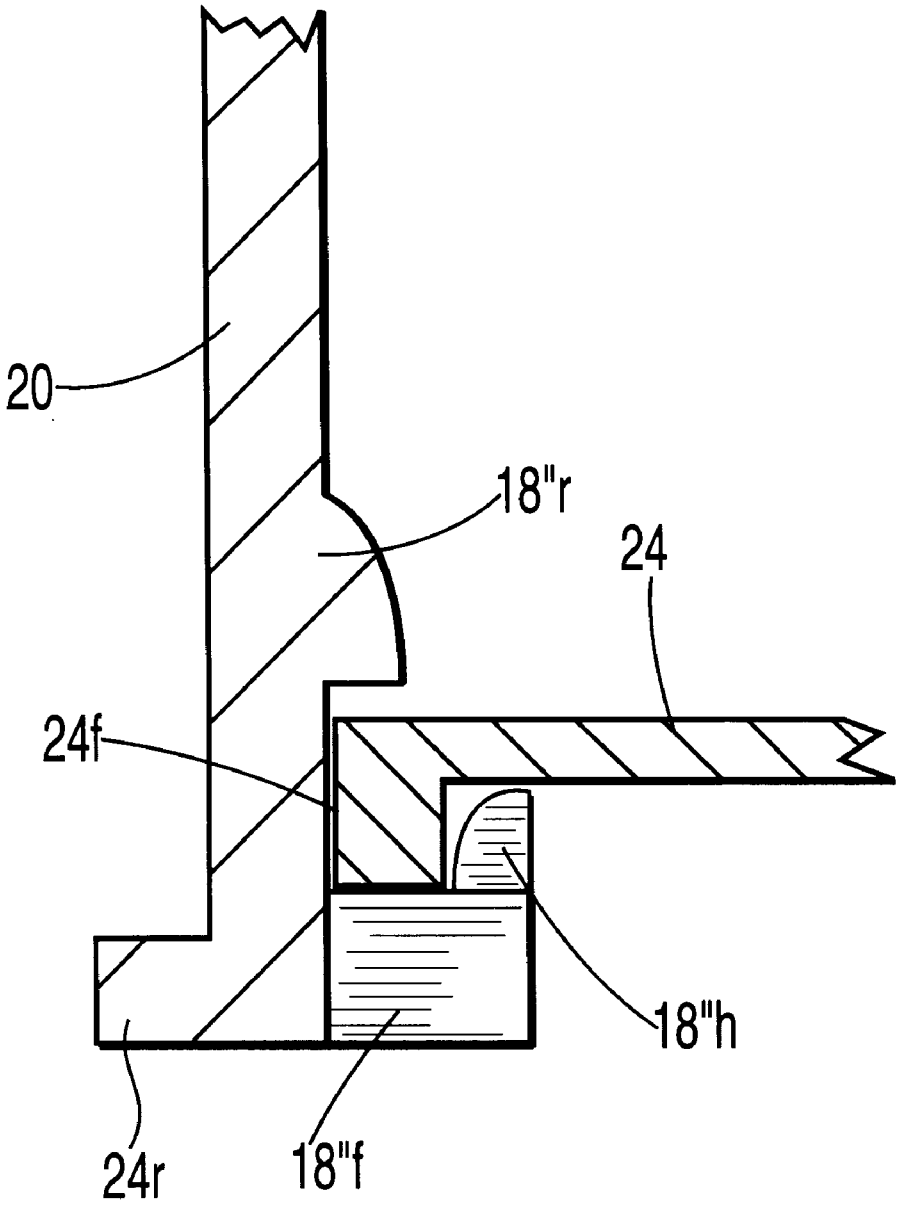
FIG. 11 is an enlarged, fragmentarily illustrated sectional view taken along line 11—11 of FIG. 6, further showing the bottom panel, snapped in place when the box is erected.

As seen best in FIGS. 6 and 11, the bottom edges 14*a*, 16*a*, 18'*a*, 18"*a*, 20*a*, 22*a* of the rectangular panels 14, 16, 18', 18", 20, 22 other than the central panel 12 are provided with bottom panel engaging flanges 14*f*, 16*f*, 18'*f*, 18"*f*, 20*f*, 22*f* to hold the bottom panel 24 when folded as described herein above and below. Preferably, the panels 16, 18', 18", and 20 are also provided with wedge-shaped locking ramps 16*r*, 18'*r*, 18"*r*, and 20*r* to help secure the placement of the bottom panel 24 in a snap-fit manner between ramps 16*r*, 18'*r*, 18"*r* and 20*r* and flanges 16*f*, 18'*f*, 18"*f*, and 20*f*. The periphery of the bottom panel is provided with a downwardly-extending flange 24*f* for engaging behind the upstanding flanges 18'*h*, 18"*h* provided on the free ends of flanges 18'*f* and 18"*f* on the rectangular panel 18' and 18" as seen in FIG. 11. In contrast to the wedge-shaped locking ramps which serve to spread apart the side walls to allow the bottom panel 24 to fold therepast, the flanges 18'*h*, 18"*h* serve to prevent outward flexing of the panels 12, 14, 16, 18, 20, 22 when the box is in an erected position and with the bottom panel 24 snapped between in place the ramps and flanges; this minimizes the possibility of the box collapsing unintentionally.

In order to strengthen the bottom panel 24, three diametrical ribs 24*a*, 24*b*, 24*c* are preferably provided on the underside thereof and the bottom of the side panels are provided with outwardly extended ribs 24*r* for better rigidity; these may also be provided on the top of the side panels, if so desired.

The cover panel 26 is provided with an upper peripheral flange 26*f* for preventing the cover from falling into the box when the cover is folded closed and is also provided with a lifting tab 26*t* for opening the cover from the closed position. Moreover, the sides 26*a*–26*e* of the cover panel 26 are recessed as seen best in FIGS. 7–9 so that the sides fit within the hexagonal box defined by the rectangular sides 12, 14, 16, 18, 20, and 22.

The box 10 (FIG. 1) is manufactured from the blank 100 by first folding the bottom panel 24 up against the interior of the central panel 12 and then ultrasonically welding the free ends 18'*e* and 18"*e* of the outermost panels 18', 18". The box 10 may then be folded substantially flat in a relatively compact configuration (FIGS. 3–5) or folded into the box configuration as shown in FIG. 1 and described above. The shelf 30 is optionally placed inside the box on the shelf supporting flanges. In order to provide the shelf 30 with additional strength, three diametrical ribs 30*c*–30*e* are preferably provided on the underside thereof.

The presently preferred embodiment of the blank 100 is injection molded from, e.g., polypropylene. The dimensions of the blank are chosen to accommodate baked goods such as pies and cakes. Thus, in a presently preferred embodiment, the assembled and erected box 10 (FIG. 1) has dimensions of approximately six inches (top to bottom) by approximately eleven inches (side to opposite side). The shelf flanges are located approximately three inches above the bottom so that the removable shelf substantially bifurcates the interior of the box into two three by eleven inch hexagonal compartments in which two pies or cakes, or muffins, donuts, etc., may be contained. When folded to the substantially flat storage configuration as shown in FIGS. 3–5, the overall dimensions of the box are approximately eighteen inches by approximately seventeen inches and approximately one half inch thick (at its center).

There have been described and illustrated herein a folding box with a removable shelf. While a preferred embodiment of the invention has been described, it is not intended that the invention be limited thereto, as it is intended that the invention be as broad in scope as the art will allow and that the specification be read likewise. Thus, while particular dimensions have been disclosed, it will be appreciated that other dimensions could be utilized. Also, while the cover panel and the bottom panel have been shown to be depending from the same side panel, it will be recognized that the cover panel and the bottom panel may depend from different side panels and may be folded in a different manner and still achieve substantially the same results. Moreover, while particular configurations have been disclosed in reference to the outermost panels of the blank, it will be appreciated that other configurations could be used as well. In particular, the coupling of the outermost panels may be achieved with a chemical adhesive, heat sealing, or by a mechanical interlocking rather than by sonic welding. It will therefore be appreciated by those skilled in the art that yet other modifications could be made to the provided invention without deviating from its spirit and scope as so claimed.

What is claimed is:

1. A foldable box, comprising:

a) six substantially rectangular side panels hingedly coupled to each other for forming a substantially hexagonal arrangement of side panels;

b) a substantially hexagonal bottom panel hingedly coupled to a bottom edge of, and integrally formed with, a first one of said six substantially rectangular side panels; and c) a substantially hexagonal top panel hingedly coupled to a top edge of, and integrally formed with, one of said six substantially rectangular side panels; and d) means for releasably locking said bottom to at least a second one of said side panels, said locking means comprising a downwardly directed flange on an edge of said bottom panel, a rim extending inwardly from a bottom section of said second one of said side panels and a flange spaced from said side panel and extending upwardly from said rim, and an inwardly extending protrusion positioned above said rim, said box comprises a folded configuration, and an erected configuration defining a hexagonal box having a bottom and an openable top, and wherein said first locking means and said second locking means matingly and releasably engage one another to maintain said erected configuration.

2. A foldable box according to claim 1, further comprising:

e) a substantially hexagonal removable shelf member which is insertable into said foldable box when said foldable box is folded to said configuration which defines a hexagonal box having a bottom and an openable top.

3. A foldable box according to claim 1, wherein:

said six substantially rectangular side panels, said bottom panel, and said top panel are integrally formed by injection molding.

4. A foldable box according to claim 1, wherein:

said bottom panel is hingedly coupled to a bottom edge of a first one of said six substantially rectangular side panels, and said top panel is hingedly coupled to a top edge of said first one of said six substantially rectangular side panels.

5. A foldable box according to claim 2, wherein:

said removable shelf member has lifting means for removing said shelf member from said foldable box.

6. A foldable box according to claim 2, further comprising:

f) shelf support means on at least two of said side panels for supporting said removable shelf.

7. A foldable box according to claim 1, wherein:

said bottom panel support means includes flange means.

8. A foldable box according to claim 3, wherein:

one of said side panels is formed in two parts which are coupled to each other subsequent to injection molding.

9. A foldable box according to claim 5, wherein:

said lifting means includes at least one cut-out.

10. A foldable box according to claim 6, wherein:

said shelf support means includes flange means.

11. A foldable box according to claim 8, wherein:

said two parts are coupled to each other by ultrasonic welding.

12. A foldable box according to claim 8, wherein:

said two parts have registration means for aligning said two parts when they are coupled to each other.

13. A foldable box according to claim 9, wherein:

said at least one cut-out comprises two arcuate cut-outs.

14. A foldable box according to claim 12, wherein:

said registration means includes tongue and groove means.

15. A foldable box according to claim 1, wherein in said folded configuration one of said bottom panel and said top panel is positionable between said side panels and the other of said top panel and said bottom panel is positionable outside and against said side panels.

16. A foldable box according to claim 1, wherein said inwardly extending protrusion is tapered.

17. A foldable box according to claim 1, comprising a plurality of said locking means.

18. A foldable box according to claim 1, comprising a plurality of rims and tapered protrusions.

19. A foldable box according to claim 18, wherein at least some of said rims and tapered protrusions are on other of said side panels.

20. A plastic, collapsible and foldable box, comprising:

a) a multiplicity of side panels hingedly coupled to each other for forming a substantially polygonal arrangement of side panels;

b) a substantially polygonal bottom panel hingedly coupled to a bottom edge of, and integrally formed with, a first one of said side panels;

c) a substantially polygonal top panel hingedly coupled to a top edge of, and integrally formed with, one of said side panels; and d) means for locking said bottom to at least a second one of said side panels, said locking means comprising a downwardly directed flange on an edge of said bottom panel, a rim extending inwardly from a bottom section of said second one of said side panels, and a flange spaced from said side panel and extending upwardly from said rim, and an inwardly extending protrusion positioned above said rim, said side panels, said bottom panel, and said top panel are foldable from a substantially flat configuration to a configuration which defines said box comprising a folded configuration, and an erected configuration defining a polygonal box having a bottom and an open able top wherein said first locking means and said second locking means matingly and releasably engage one another to maintain said erected configuration.

21. A foldable box according to claim 20, wherein said bottom panel and said side panels having cooperating releasable, lockable flange members which afford snap-fit engagement of said bottom panel to said side panels when said box is in said erected configuration.

22. A foldable box according to claim 20, wherein said inwardly extending protrusion is tapered.

23. A foldable box according to claim 20, comprising a plurality of said locking means.

24. A foldable box according to claims 20, comprising a plurality of rims and tapered protrusions.

25. A foldable box according to claim 24, wherein at least some of said rims and tapered protrusions are on other of said side panels.

* * * * *